US009288872B2

(12) United States Patent
Van De Sluis et al.

(10) Patent No.: US 9,288,872 B2
(45) Date of Patent: Mar. 15, 2016

(54) CONTROL DEVICE FOR CONTROLLING A LIGHTING EFFECT

(75) Inventors: Bartel Marinus Van De Sluis, Eindhoven (NL); Bram Knaapen, Eindhoven (NL); Anthonie Hendrik Bergman, Nuenen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 235 days.

(21) Appl. No.: 13/980,213

(22) PCT Filed: Jan. 16, 2012

(86) PCT No.: PCT/IB2012/050193

§ 371 (c)(1),
(2), (4) Date: Jul. 17, 2013

(87) PCT Pub. No.: WO2012/101541

PCT Pub. Date: Aug. 2, 2012

(65) Prior Publication Data

US 2013/0293142 A1 Nov. 7, 2013

(30) Foreign Application Priority Data

Jan. 25, 2011 (EP) ..... 11152018

(51) Int. Cl.
*H05B 37/00* (2006.01)
*H05B 37/02* (2006.01)

(52) U.S. Cl.
CPC ..... *H05B 37/02* (2013.01); *H05B 37/029* (2013.01)

(58) Field of Classification Search
CPC ..... H05B 37/02; H05B 37/029
USPC ..... 315/185 R, 312
See application file for complete search history.

(56) References Cited

U.S. PATENT DOCUMENTS

| | | | | |
|---|---|---|---|---|
| 6,593,902 | B1 | 7/2003 | Ogino et al. | |
| 7,367,684 | B2 * | 5/2008 | D'Souza | 362/104 |
| 8,303,129 | B1 * | 11/2012 | Thielen | 362/103 |
| 8,573,797 | B2 * | 11/2013 | Spartano et al. | 362/191 |
| 2005/0116667 | A1 | 6/2005 | Mueller et al. | |
| 2005/0248935 | A1 | 11/2005 | Strip et al. | |
| 2006/0187081 | A1 | 8/2006 | Gloisten | |
| 2008/9030925 | | 12/2008 | Snijder et al. | |

FOREIGN PATENT DOCUMENTS

| | | | |
|---|---|---|---|
| CN | 101793364 | A | 8/2010 |
| WO | 2005107337 | A1 | 11/2005 |
| WO | 2008059412 | A1 | 5/2008 |
| WO | 2009004539 | A1 | 1/2009 |
| WO | 2009069076 | A2 | 6/2009 |

* cited by examiner

*Primary Examiner* — Kenneth B Wells
(74) *Attorney, Agent, or Firm* — Meenakshy Chakravorty

(57) ABSTRACT

The disclosed embodiments relate to functional and decorative lighting. At least one control device (200*a*, 200*b*) is connected to a plurality of lighting elements (2000). The control devices (200*a*, 200*b*) are arranged to control lighting effects of the plurality of lighting elements (2000).

14 Claims, 4 Drawing Sheets

CONTROL DEVICE FOR CONTROLLING A LIGHTING EFFECT

FIELD OF THE INVENTION

The present invention relates to functional and decorative lighting.

BACKGROUND OF THE INVENTION

There are several means for displaying and supplying information, such as, e.g., signs, posters, television, interactive screens, etc. It is generally desired that the information is displayed both clearly and decoratively.

Usually, the means used for displaying information is quite static. Once installed, it is not easily expandable, and when not in use, it may constitute a quite ugly piece such as, e.g., a huge television set.

There is thus a need to improve the means used for displaying information in terms of flexibility, etc.

SUMMARY OF THE INVENTION

It is an object of the present invention to overcome this problem, and to provide lighting that is decorative. It is a secondary object to provide lighting that is functional.

According to a first aspect of the invention, this and other objects are achieved by a control device for controlling at least one lighting effect of at least one lighting element of a plurality of interconnected lighting elements, wherein the control device is arranged to be connected to a lighting element chosen from the plurality of interconnected lighting elements, and wherein the control device, when it is connected to said lighting element, is arranged to control said at least one lighting effect of at least one lighting element of the plurality of interconnected lighting elements.

The control device is connectable to any one of the plurality of lighting elements, which is advantageous in that very flexible lighting is achieved, since it is easily extendible and scalable. Furthermore, no central control is necessary. Instead, the position of the control depends on the position of the control device.

The control device may further comprise at least one attachment part, wherein the at least one attachment part is arranged to be connected to at least one receiving part of a lighting element chosen from the plurality of interconnected lighting elements.

At least one of the group of: the control device and at least one lighting element of the plurality of interconnected lighting elements, may comprise an orientation sensor. This enables controlling of lighting effects, e.g., in such a manner that only the lighting element above and the lighting element underneath the control device or the particular lighting element are affected. The orientation sensor may, e.g., be an accelerometer.

The control device may be arranged to activate said at least one lighting effect upon receiving an indication from a detector, wherein said detector is at least one of the group of: a light sensor, a vision-based sensor, a weather sensor, a color sensor, a fragrance sensor, a humidity sensor, a temperature sensor, a movement detector, a heat detector, a microphone coupled to means for speech recognition, and a camera. In this way, energy can be saved in that the lights are not lit when there is nobody in the vicinity of the control device and the lighting elements. As an alternative, magnificent lighting applications can be created including, e.g., that lighting elements light up only when a person goes past them.

The control device may be arranged to activate said at least one lighting effect when the control device is connected to said lighting element. This is advantageous in that the lighting effect may start automatically upon connecting the control device to the lighting element.

The control device may comprise at least one input means for operating the at least one lighting effect of at least one lighting element of the plurality of interconnected lighting elements. This is advantageous in that it is easy to operate the at least one lighting effect of at least one lighting element of the plurality of interconnected lighting elements.

The input means may be at least one of the group of: a touch input such as a touch screen, a microphone coupled to means for speech recognition, a camera, a slide switch, a switch, and a circle comprising a plurality of segments of different colors, each segment being a separate color input means.

Upon activation of the at least one input means, the control device may be arranged to turn on and turn off the plurality of lighting elements in a predetermined manner. The predetermined manner could be, e.g., imitate a sunrise.

Upon operation of the at least one input means, the control device may be arranged to select at least one of the group of: adjust at least one of: a hue, a saturation, a brightness, an intensity, and a color of light emitted from at least one of the plurality of interconnected lighting elements, turn on/off the plurality of interconnected lighting elements, control for which lighting element of the plurality of interconnected lighting elements, the lighting effect is arranged to be activated, and adjust a range of light emitted from at least one of the plurality of interconnected lighting elements.

The control device may incorporate at least one of the group of: a radio receiver, a television receiver, and a connection to the Internet. This is advantageous in that the control device can be remote-controlled.

The control device may be programmable via at least one of the group of: a keyboard, a radio connection, an infrared connection, a smart card, a USB memory stick, a wi-fi connection, a Bluetooth connection, and a ZigBee connection. This is advantageous in that the control device can be remote-controlled.

Light emitted from at least one lighting element of the plurality of interconnected lighting elements may be backlight. In an embodiment, the light emitted from the at least one lighting element of the plurality of interconnected lighting elements may be backlight and frontlight. The light emitted from the plurality of lighting elements may be at least one of backlight and frontlight.

The plurality of interconnected lighting elements may comprise at least one respective light emitting device which comprises at least one of the group of: a light-emitting diode, an organic light-emitting diode, and a liquid crystal display.

According to a second aspect of the invention, this and other objects are achieved by a lighting system. The lighting system comprises: a plurality of control devices according to the first aspect, a plurality of interconnected lighting elements, wherein the control devices are connected to a respective lighting element chosen from the plurality of interconnected lighting elements, and wherein the control devices are each arranged to control at least one lighting effect of at least one lighting element of the plurality of interconnected lighting elements. The lighting system can be used as a means for both information and decoration. The plurality of lighting elements may, e.g., illustrate the status of a sleeping baby, the amount of online activity within a Hyves and/or Facebook community, or it could indicate how the weather is expected to develop in the coming hours. Furthermore, the second aspect can be embodied in accordance with the first aspect.

At least one lighting element of the plurality of interconnected lighting elements may be arranged to be controlled by at least one of the plurality of control devices.

The advantages of the first aspect are equally applicable to the second aspect.

According to a third aspect of the invention, this and other objects are achieved by a method of controlling at least one lighting effect of at least one lighting element of a plurality of interconnected lighting elements. The method comprises: connecting a control device to a lighting element chosen from the plurality of interconnected lighting elements, wherein the control device, when it is connected to said lighting element, is arranged to control said at least one lighting effect of at least one lighting element of the plurality of interconnected lighting elements.

The advantages of the first aspect are equally applicable to the third aspect. Furthermore, the third aspect can be embodied in accordance with the first aspect.

It is noted that the invention relates to all possible combinations of features recited in the claims.

BRIEF DESCRIPTION OF THE DRAWINGS

This and other aspects of the present invention will now be described in more detail, with reference to the appended drawings showing embodiments of the invention, in which.

DETAILED DESCRIPTION

Figure 1:
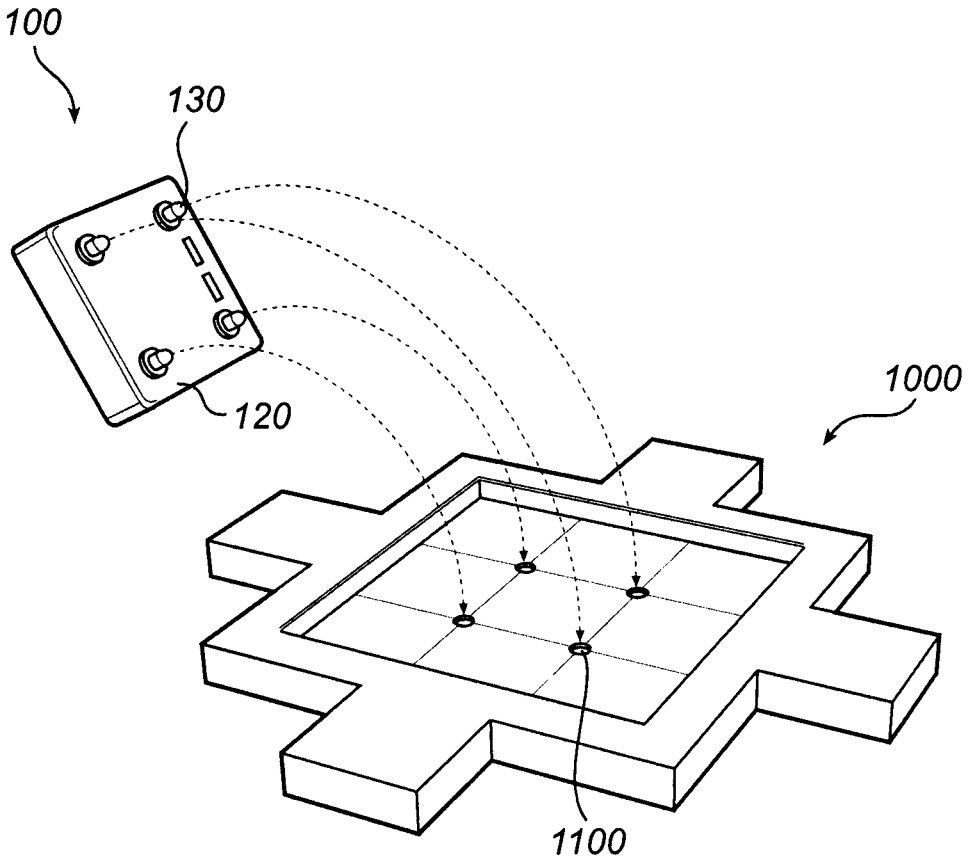
FIG. 1 is a perspective view of a lighting element and of a rear side of an embodiment of the inventive control device.

FIG. 1 illustrates a rear side 120 of an embodiment of a control device 100. FIG. 1 further discloses a lighting element 1000. The control device 100 is arranged to be connected to the lighting element 1000 by means of at least one attachment part 130. In this specific embodiment, the control device 100 comprises four attachment parts 130. The at least one attachment part 130 is arranged to be connected to at least one receiving part 1100 in the lighting element 1000. In this specific embodiment, the lighting element 1000 comprises four receiving parts 1100. The at least one attachment part 130 may be clicked or snapped into the at least one receiving part 1100. The at least one attachment part 130 may be a magnet and may be magnetically connected to the at least one receiving part 1100, which in such a case is made of a ferromagnetic material. Alternatively, the at least one attachment part 130 and the at least one receiving part 1100 may be made of hook and loop fasteners, such as Velcro®.

Upon connecting the at least one attachment part 130 to the at least one receiving part 1100, a power and data connection is set up between the control device 100 and the lighting element 1000.

Figure 2:
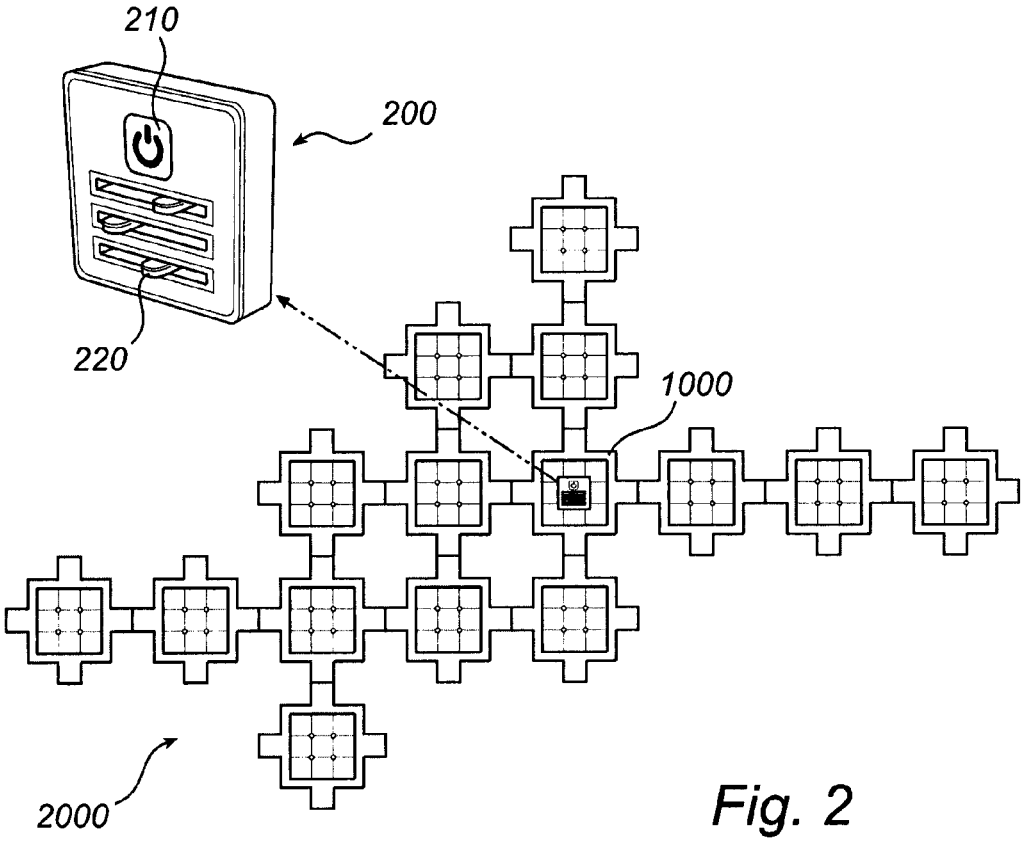
FIG. 2 is an elevational view of a plurality of interconnected lighting elements and a perspective view of an embodiment of the inventive control device.

FIG. 2 discloses a perspective view of an embodiment of a control device 200. The control device 200 comprises an input means, in this case a switch 210 which is an on/off switch. The control device 200 further comprises three slide switches 220.

FIG. 2 also discloses an elevational view of a plurality of interconnected lighting elements 2000. The control device 200 is connected to one of the plurality of interconnected lighting elements 2000, viz. the lighting element 1000. The lighting element 1000 can be chosen arbitrarily.

The control devices described herein can be connected to any one of the lighting elements described herein. Furthermore, the plurality of lighting elements can be simultaneously controlled by more than one control device. In one embodiment, a first control device is connected to one of the plurality of lighting elements. Next, a second control device is connected to the plurality of lighting elements. In this embodiment, the lighting effect of the second control device prevails over that of the first control device, i.e. the most recently connected control device prevails over the earlier-connected control devices. For example, if the lighting effect of the first control device is that the plurality of lighting elements are to emit red light, the plurality of lighting elements start to emit red light upon connection of the first control device. If the lighting effect of the second control device is that the plurality of lighting elements are to imitate a sunrise, then, upon connection of the second control device to the plurality of lighting elements, the plurality of lighting elements start to imitate a sunrise.

In another embodiment, the lighting effects of the control devices co-exist. For example, a third control device, controlling backlight, is connected to the plurality of lighting elements. Further, a fourth control device, controlling brightness, is connected to the plurality of lighting elements. Even though both the third and the fourth control device are connected to the plurality of lighting elements, both control devices are able to control their respective lighting elements.

The slide switches 220 can be arranged to control different lighting effects of the lighting elements. The lighting effects can be, e.g., at least one of the group of: adjust a color of the light emitted from at least one of the plurality of interconnected lighting elements 2000, adjust an intensity of the light emitted from at least one of the plurality of interconnected lighting elements 2000, and adjust a range of the light emitted from at least one of the plurality of interconnected lighting elements 2000.

Figure 3:
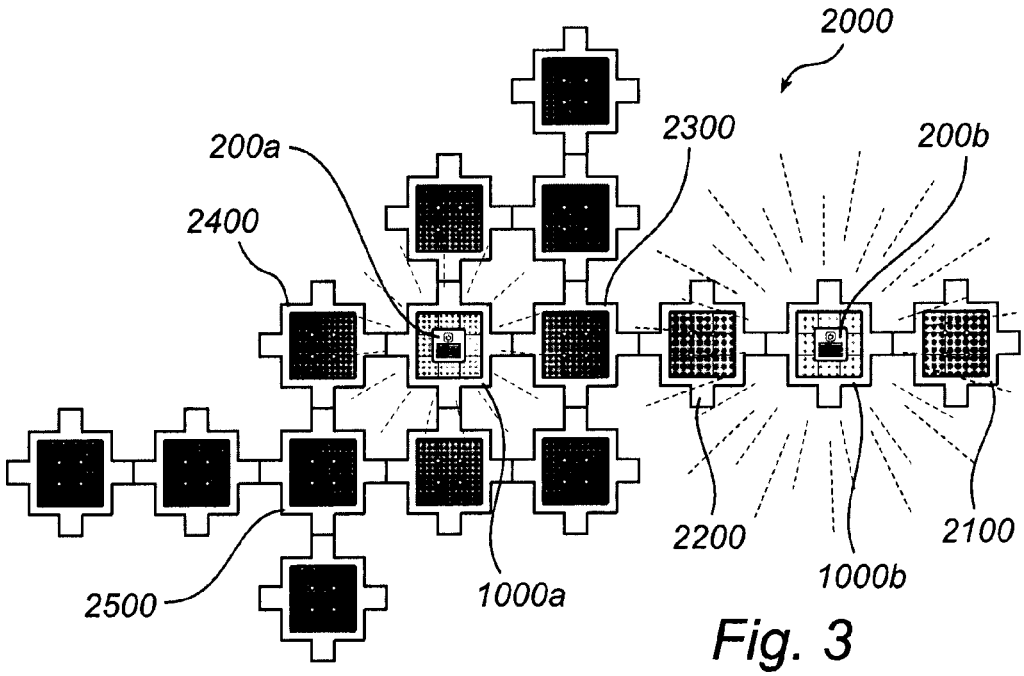
FIG. 3 is an elevational view of a plurality of interconnected lighting elements and of two embodiments of the inventive control device.

FIG. 3 is an elevational view of a plurality of interconnected lighting elements 2000. A control device **200*a* has been connected to a lighting element 1000*a* and another control device 200*b* has been connected to another lighting element 1000*b***.

Slide switches 220 of control device **200*a* have been positioned so that the lighting element 1000*a* is controlled to emit light of a first color and at a first intensity. Furthermore, the slide switches 220 of control device 200*a* have been positioned so that the immediately adjacent lighting elements such as, e.g., lighting element 2400, are controlled to emit light of the first color but at a lower intensity than the first intensity. Moreover, the slide switches 220 of control device 200*a* have been positioned so that the adjacent lighting elements such as, e.g., lighting element 2500**, are controlled not to emit any light.

Slide switches 220 of control device **200*b* have been positioned so that the lighting element 1000*b* is controlled to emit light of a second color and at a second intensity. Furthermore, the slide switches 220 of control device 200*b* have been positioned so that the immediately adjacent lighting elements, lighting element 2100 and 2200**, are controlled to emit light of the second color but at a lower intensity than the second intensity.

Figure 4:
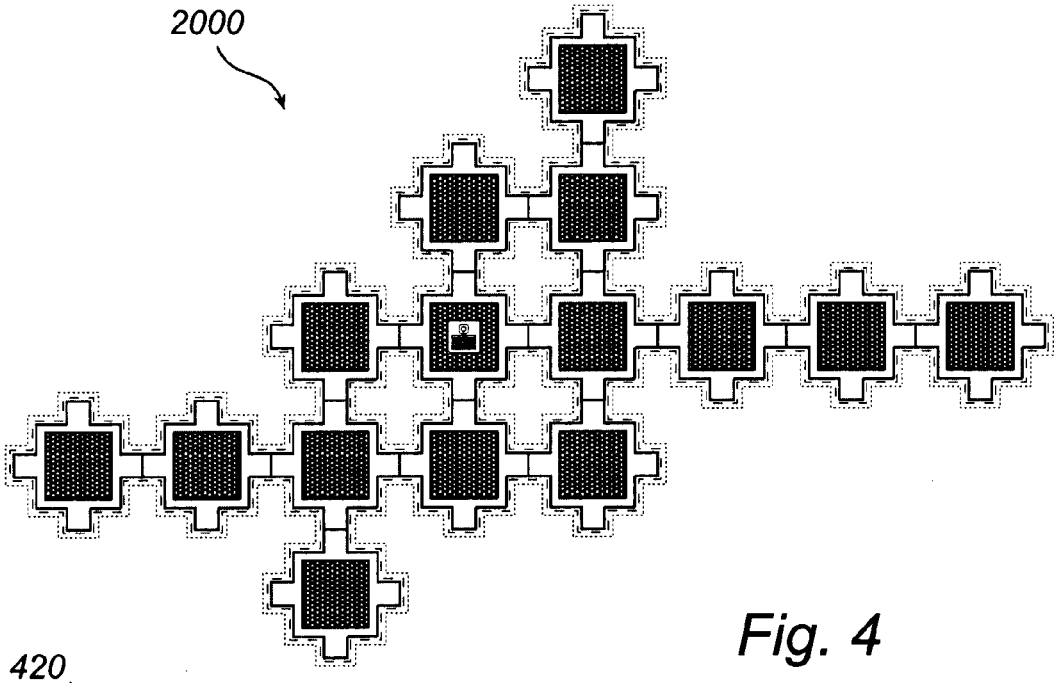
FIG. 4 is an elevational view of a plurality of interconnected lighting elements.

FIG. 4 is an elevational view of a plurality of interconnected lighting elements 2000. A control device 200, such as the one shown in FIG. 2, has been connected to a lighting element 1000. Slide switches 220 of control device 200 have been positioned so that the plurality of interconnected lighting elements 2000 emit backlight.

Figure 5:
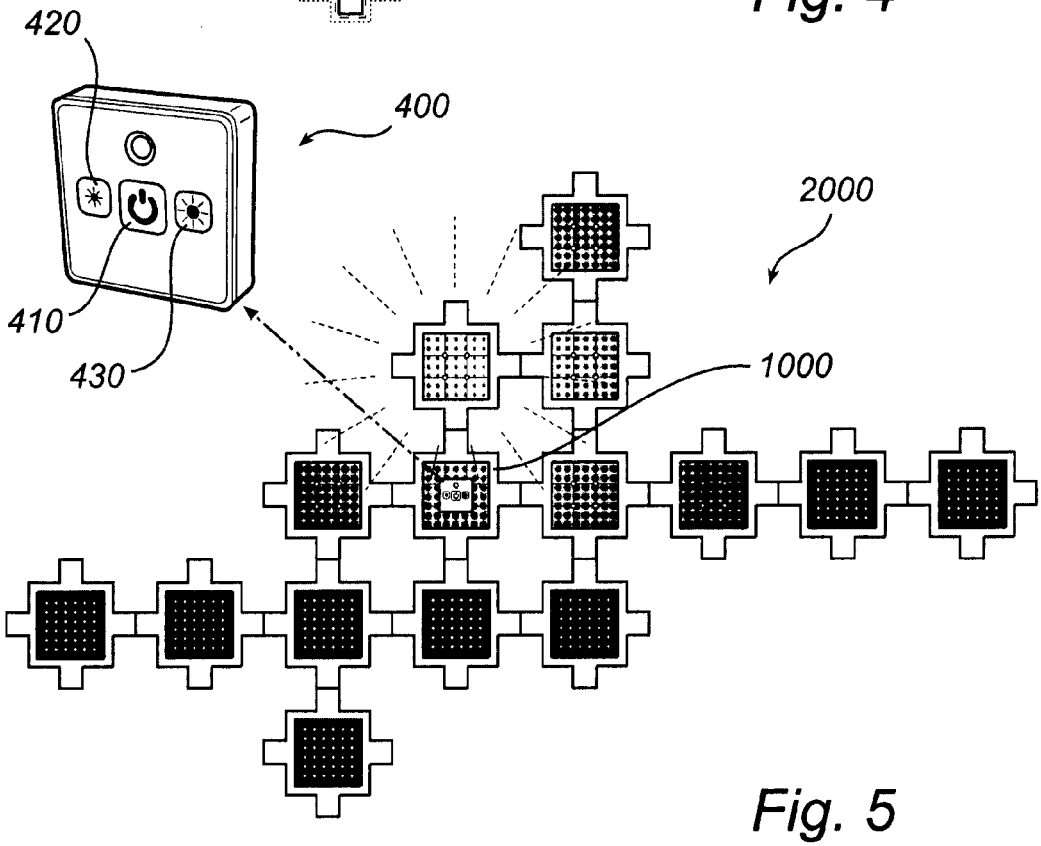
FIG. 5 is an elevational view of a plurality of interconnected lighting elements and a perspective view of an embodiment of the inventive control device.

FIG. 5 is an elevational view of a plurality of interconnected lighting elements 2000 and a perspective view of a control device 400. The control device 400 has been connected to lighting element 1000. The control device 400 comprises three switches 410, 420, and 430. Switch 410 is an on/off switch. When the switch 410 is pressed, the lighting effect controlled by the control device 400 is turned on/off. The lighting effect to be controlled by the control device 400 according to its arrangement is that the plurality of lighting elements 2000 are lit and switched off in a predetermined manner. More specifically, upon pressing switch 420, the plurality of lighting elements 2000 are lit and switched off in a predetermined manner in order to imitate a sunset. Alternatively, the lighting effect is started automatically upon connection of the control device 400 to one of the plurality of lighting elements 2000. The lighting elements 2000 are, e.g., controlled by the control device 400 to emit light of different colors of red, orange and yellow. Similarly, upon pressing switch 430, the plurality of lighting elements 2000 are lit and switched off in a predetermined manner in order to imitate a sunrise. The lighting elements 2000 are, e.g., controlled by the control device 400 to emit light of different colors of red, orange and yellow.

Figure 6:
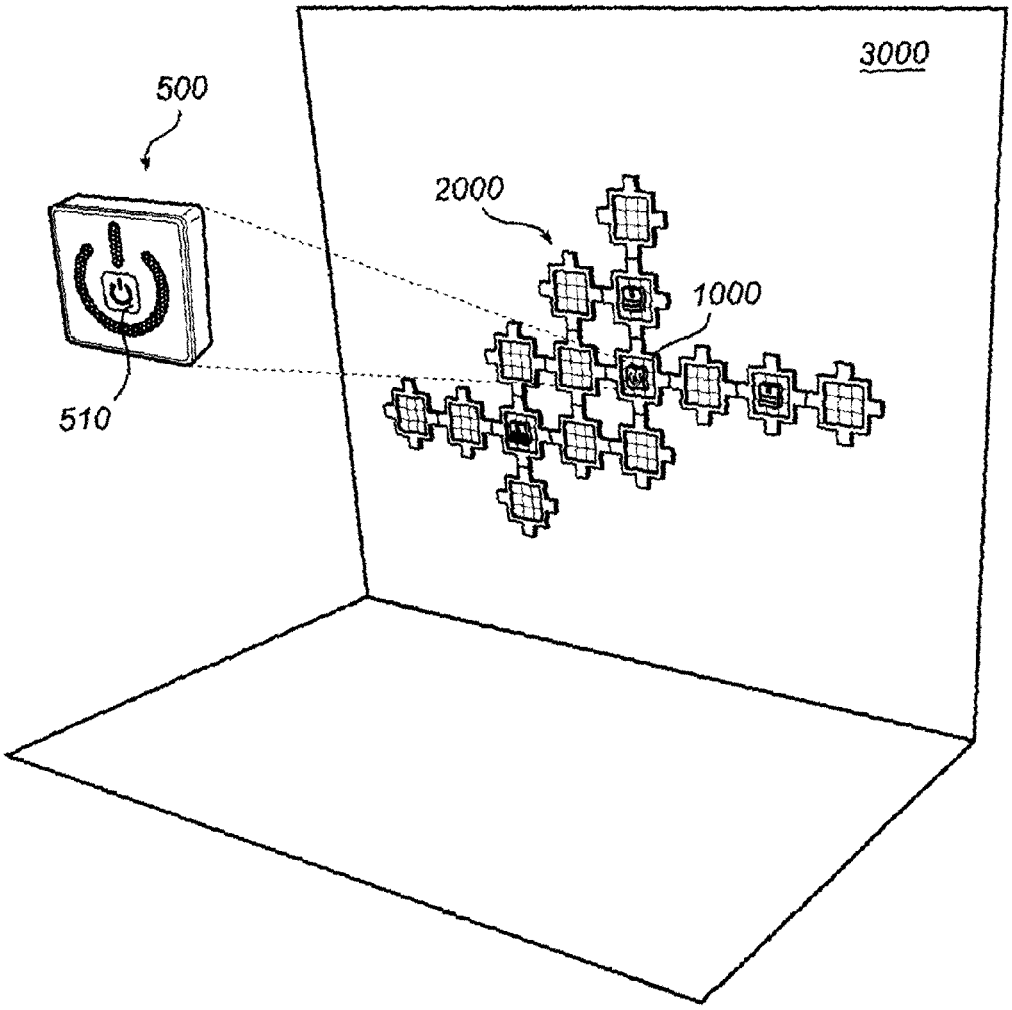
FIG. 6 is a perspective view of an embodiment of the inventive control device and of a plurality of interconnected lighting elements arranged at a wall.

FIG. 6 is a perspective view of a control device 500 and of a plurality of interconnected lighting elements 2000 arranged at a wall 3000. The control device 500 comprises an on/off switch 510. When the switch 510 is pressed, the plurality of lighting elements 2000 are turned on/off.

In FIG. 6, three other control devices have also been connected to the plurality of lighting elements 2000. In one embodiment, even if the other control devices are controlling lighting effects of some or all of the plurality of lighting elements, the plurality of lighting elements 2000 are turned off upon the on/off switch 510 being pressed.

In one embodiment, at least one control device comprises a presence sensor. The presence sensor can be, e.g., a movement detector or a heat detector. The control device can be arranged to activate its lighting effect upon receiving an indication from the presence sensor. The presence sensor is herein also referred to as detector. Alternatively, the presence sensor is not arranged in the control device. Instead, the presence sensor and the control device are arranged to communicate with each other.

In one embodiment, the control device comprises at least one switch for controlling the size of its lighting effect. For example, the lighting effect could be that a circle of light is emitted from the lighting element to which the control device is attached. By pressing the switch, the size of the circle of light is increased/decreased. The size of the circle of light could be increased/decreased by lighting the lighting elements adjacent to the lighting element to which the control device is attached.

In summary, the disclosed embodiments relate to functional and decorative lighting. At least one control device 200*a*, 200*b*, is connected to a plurality of lighting elements 2000. The control devices 200*a*, 200*b* are arranged to control lighting effects of the plurality of lighting elements 2000.

The person skilled in the art realizes that the present invention by no means is limited to the preferred embodiments described above. On the contrary, many modifications and variations are possible within the scope of the appended claims. For example, different lighting effects can be generated by adjusting different switches. Alternatively, the lighting effects can be pre-set so that lighting effects are predetermined for every control device such as, e.g., sunrise and sunset.

The control device may comprise a storage means and a processing means.

The lighting effect generated by the control device may be dependent on the position of the control device, i.e. to which lighting element it is attached. The lighting effect of the control device could be, e.g., that the lighting element situated above and the lighting element situated below the control device are to be lit whereas the lighting elements to the left and to the right are to be turned off. The orientation of the control device may be determined using, e.g., an accelerometer.

The inventive control device may, e.g., incorporate at least one of a radio receiver, a television receiver, and a connection to the Internet. The control device can be programmable via a keyboard, a radio connection, an infrared connection, a smart card, a USB memory stick, a wi-fi connection, a Bluetooth connection, and a ZigBee connection.

The plurality of lighting elements can be controlled by control devices to, e.g., display the number of people in a cafeteria, illustrate the status of a sleeping baby, the amount of online activity within a Hyves and/or Facebook community, or could indicate how the weather is expected to develop in the coming hours.

In the following, a description is given of a method of controlling a lighting element 1000 chosen from a plurality of lighting elements 2000, wherein the lighting element 1000 is connected to the other lighting elements of the plurality of lighting elements 2000. A control device is connected to the lighting element 1000, the control device comprising at least one switch for controlling a lighting effect of the lighting element 1000. The at least one switch is operated. The control device, when it is connected to said lighting element 1000, is arranged to control said at least one lighting effect of said lighting element 1000. The control device, when it is connected to said lighting element 1000, may control at least one adjacent lighting element.

The input means of the control devices may be embodied in many different ways, e.g., the input means may be a touch input such as a touch screen. Alternatively, the input means may be a microphone coupled to means for speech recognition.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope thereof.

The invention claimed is:

1. Control device for controlling at least one lighting effect of at least one lighting element of a plurality of interconnected lighting elements, wherein the control device comprises at least one attachment part, and wherein the control device is arranged to be connected to a lighting element chosen from any of the plurality of interconnected lighting elements by means of said at least one attachment part, wherein the control device, when it is connected to said lighting element, is arranged to control said at least one lighting effect of at least one lighting element of the plurality of interconnected lighting elements, wherein said at least one lighting effect is dependent on the position of the control device connected to said lighting element, and wherein the control device incorporates at least one of the group of: a radio receiver, a television receiver, and a connection to the Internet.

2. Control device according to claim 1, wherein said at least one attachment part is arranged to be connected to at least one receiving part of a lighting element chosen from the plurality of interconnected lighting elements.

3. Control device according to claim 1, wherein said control device is arranged to activate said at least one lighting effect when the control device is connected to said lighting element.

4. Control device according to claim 1, wherein the control device comprises at least one input means for operating the at least one lighting effect of at least one lighting element of the plurality of interconnected lighting elements.

5. Control device according to claim 4, wherein the input means is selected from the group consisting of: a touch input such as a touch screen, a microphone coupled to means for speech recognition, a camera, a slide switch, a switch, and a circle comprising a plurality of segments of different colors, each segment being a separate color input means.

6. Control device according to claim 4, wherein, upon operation of the at least one input means, the control device is arranged to select at least one of the group of: adjust at least one of: a hue, a saturation, a brightness, an intensity, and a color of light emitted from at least one of the plurality of interconnected lighting elements, turn on/off the plurality of interconnected lighting elements, control for which lighting element of the plurality of interconnected lighting elements the lighting effect is arranged to be activated, and adjust a range of light emitted from at least one of the plurality of interconnected lighting elements.

7. Lighting system comprising:

a plurality of control devices according claim 1, a plurality of interconnected lighting elements, wherein the control devices are connected to a respective lighting element chosen from any of the plurality of interconnected lighting elements, and wherein the control devices are each arranged to control at least one lighting effect of at least one lighting element of the plurality of interconnected lighting elements, wherein the at least one lighting effect is dependent on the position of the control device connected to the respective lighting element.

8. Lighting system according to claim 7, wherein at least one lighting element of the plurality of interconnected lighting elements is arranged to be controlled by at least one of the plurality of control devices.

9. Control device for controlling at least one lighting effect of at least one lighting element of a plurality of interconnected lighting elements, wherein the control device comprises at least one attachment part, and wherein the control device is arranged to be connected to a lighting element chosen from any of the plurality of interconnected lighting elements by means of said at least one attachment part, wherein the control device, when it is connected to said lighting element, is arranged to control said at least one lighting effect of at least one lighting element of the plurality of interconnected lighting elements, wherein said at least one lighting effect is dependent on the position of the control device connected to said lighting element, and wherein said control device is arranged to activate said at least one lighting effect upon receiving an indication from a detector, wherein said detector is at least one of the group of: a light sensor, a vision-based sensor, a weather sensor, a color sensor, a fragrance sensor, a humidity sensor, a temperature sensor, a movement detector, a heat detector, a microphone coupled to means for speech recognition, and a camera.

10. Control device for controlling at least one lighting effect of at least one lighting element of a plurality of interconnected lighting elements, wherein the control device comprises at least one attachment part, and wherein the control device is arranged to be connected to a lighting element chosen from any of the plurality of interconnected lighting elements by means of said at least one attachment part, wherein the control device, when it is connected to said lighting element, is arranged to control said at least one lighting effect of at least one lighting element of the plurality of interconnected lighting elements, wherein said at least one lighting effect is dependent on the position of the control device connected to said lighting element, and wherein the control device is programmable via at least one of the group of: a keyboard, a radio connection, an infrared connection, a smart card, a USB memory stick, a wi-fi connection, a Bluetooth connection, and a ZigBee connection.

11. Lighting system according to claim 10, wherein at least one of the group of: the control devices and at least one lighting element of the plurality of interconnected lighting elements comprises an orientation sensor.

12. Lighting system according to claim 10, wherein light emitted from at least one of the plurality of interconnected lighting elements is backlight.

13. Lighting system according to claim 10, wherein the plurality of interconnected lighting elements comprise at least one respective light emitting device which comprises at least one of the group of: a light-emitting diode, an organic light-emitting diode, and a liquid crystal display.

14. Method of controlling at least one lighting effect of at least one lighting element of a plurality of interconnected lighting elements, comprising:

connecting a control device comprising at least one attachment part to a lighting element chosen from any of the plurality of interconnected lighting elements by means of said at least one attachment part, wherein the control device, when it is connected to said lighting element, is arranged to control said at least one lighting effect of at least one lighting element of the plurality of interconnected lighting elements, wherein said at least one lighting effect is dependent on the position of the control device connected to said lighting element, wherein the control device incorporates at least one of the group of: a radio receiver, a television receiver, and a connection to the Internet.

* * * * *